US011682859B2

(12) United States Patent
Altshuler

(10) Patent No.: US 11,682,859 B2
(45) Date of Patent: Jun. 20, 2023

(54) CONNECTOR OR BAYONET STYLE CONNECTOR AND METHODS FOR INCORPORATING OR USING CONNECTOR

(71) Applicant: Canon U.S.A., Inc., Melville, NY (US)

(72) Inventor: Alexander Altshuler, Cambridge, MA (US)

(73) Assignee: Canon U.S.A., Inc., Melville, NY (US)

( * ) Notice: Subject to any disclaimer, the term of this patent is extended or adjusted under 35 U.S.C. 154(b) by 148 days.

(21) Appl. No.: 17/161,439

(22) Filed: Jan. 28, 2021

(65) Prior Publication Data

US 2021/0265775 A1 Aug. 26, 2021

Related U.S. Application Data

(60) Provisional application No. 62/980,717, filed on Feb. 24, 2020.

(51) Int. Cl.
*H01R 13/625* (2006.01)
*H01R 13/629* (2006.01)
(Continued)

(52) U.S. Cl.
CPC ..... *H01R 13/625* (2013.01); *H01R 13/213* (2013.01); *H01R 13/62927* (2013.01); *H01R 13/639* (2013.01); *H01R 24/005* (2013.01)

(58) Field of Classification Search
CPC ..... H01R 13/625; H01R 13/62927; H01R 13/639; H01R 24/005; H01R 13/629; H01R 13/631; H01R 13/635; H01R 13/213
See application file for complete search history.

(56) References Cited

U.S. PATENT DOCUMENTS 6,108,865 A 8/2000 Veser et al.
8,177,575 B2 * 5/2012 Katagiyama ..... H01R 13/625 439/345
(Continued)

FOREIGN PATENT DOCUMENTS

DE 102015117509 A1 * 4/2017 ..... H01R 13/447
DE 102015117509 A1 4/2017
(Continued)

OTHER PUBLICATIONS

Bayonet mount, From Wikipedia, the free encyclopedia, https://en.wikipedia.org/wiki/Bayonet_mount, last modified on Mar. 19, 2021.

*Primary Examiner* — Travis S Chambers
(74) *Attorney, Agent, or Firm* — Canon U.S.A., Inc. I.P. Division

(57) ABSTRACT

A connector, a bayonet-style connector, and methods for using the connector or bayonet-style connector are provided. At least one connector includes a receiver having an inner volume to receive a connector, and having a pawl; and a pushbutton or actuator that operates to move or unlock the pawl so that a user can insert and lock and/or unlock and remove the connector using only a single hand of the user. At least one bayonet-style connector includes a connector portion having an opening; a receptacle portion that operates to slidingly accept the connector portion and that has a pawl that operates to engage with the opening to lock the connector portion in place; and an actuator that operates to impart force on the pawl to unlock the connector portion so that a user can remove the connector portion using only one hand of the user.

21 Claims, 4 Drawing Sheets

(51) Int. Cl.

| | |
|---|---|
| ***H01R 13/639*** | (2006.01) |
| ***H01R 24/00*** | (2011.01) |
| ***H01R 13/213*** | (2006.01) |

(56) References Cited

U.S. PATENT DOCUMENTS

| | | | | |
|---|---|---|---|---|
| 9,360,630 | B2 | 6/2016 | Jenner et al. | |
| 9,869,828 | B2 | 1/2018 | Altshuler | |
| 10,337,987 | B2 | 7/2019 | Wu et al. | |
| 2014/0170888 | A1 | 6/2014 | Chien | |
| 2014/0184158 | A1* | 7/2014 | Osawa | B60L 3/04 320/109 |
| 2015/0346436 | A1* | 12/2015 | Pepe | H01R 24/64 385/76 |
| 2017/0294741 | A1 | 10/2017 | Altshuler | |
| 2019/0221970 | A1* | 7/2019 | Wu | H01R 13/629 |

FOREIGN PATENT DOCUMENTS

| | | | | |
|---|---|---|---|---|
| DE | 102018210050 | A1 * | 12/2019 | |
| EP | 2879243 | A1 * | 6/2015 | F16B 17/00 |
| FR | 2678440 | A1 | 12/1992 | |
| GB | 2411527 | A | 8/2005 | |
| JP | H3-112888 | U | 11/1991 | |
| JP | 2000-113934 | A | 4/2000 | |
| JP | 2002-329551 | A | 11/2002 | |

* cited by examiner

CONNECTOR OR BAYONET STYLE CONNECTOR AND METHODS FOR INCORPORATING OR USING CONNECTOR

CROSS-REFERENCE TO RELATED APPLICATION(S)

This application relates, and claims priority, to U.S. Patent Application Ser. No. 62/980,717, filed Feb. 24, 2020, the entire disclosure of which is incorporated by reference herein in its entirety.

FIELD OF THE DISCLOSURE

The present disclosure relates generally to a bayonet style (or bayonet-style) connector and methods for using the connector, and more particularly to a bayonet style connector that operates using single-handed manipulation by a user.

BACKGROUND OF THE DISCLOSURE

Push-in connectors such as Bayonet connectors, RJ-xx electrical connectors, LC and E2000 optical fiber connectors, or connectors for transmitting other types of signals or media, such as gases or liquids, are incorporated in a multitude of industries for use with a wide array of machinery and components.

By way of example, bayonet style connectors are well known and widely used in a range of different applications, and are designed for simple single-handed connection and disconnection. In general, bayonet connectors use an axial spring element to lock the connector in place at the end of a rotational cam motion (See FIG. 1). These types of connectors are functional for single-handed connecting/disconnecting to a large, heavy, or anchored receiver (and/or other large, heavy, and/or anchored devices).

However, when single-handed connecting/disconnecting is attempted on a light and/or unattached receiver (and/or other device(s)), the instability of the receiver (or other device) in combination with the force exerted by the connecting/disconnecting motion leads to movement of the receiver (or other device), thus forcing one to embrace the receiver with a second hand in order to counter the force exerted on the connector.

Accordingly, there is a need for an improved bayonet style connector, which can be truly manipulated single handedly (e.g., without a separate or additional tool), regardless of a weight, size, and/or stability of the receiver (or other device).

SUMMARY

Accordingly, the present disclosure provides a connecting apparatus and method for using the apparatus, capable of single-handed engagement and disengagement of the connector from a receiver (or other device).

In one or more embodiments, a connecting and/or disconnecting device or system may include: a receiver or receptacle having an inner volume that operates to receive a connector, and having a pawl or locking mechanism that operates to move towards and at least be partially positioned in a portion of the inner volume of the receiver or receptacle; and a pushbutton or actuator that operates to move or unlock the pawl or locking mechanism such that the pawl or locking mechanism operates to move away from and/or out of the inner volume of the receiver or receptacle, and/or operates to move or lock the pawl or locking mechanism such that the pawl or locking mechanism operates to move towards and/or into the inner volume of the receiver or receptacle.

In one or more embodiments, a device or system may further include: the connector positioned in the inner volume of the receiver or receptacle, wherein the pawl or locking mechanism further operates to engage with, and/or disengage from, a window or opening in a portion or side of the connector, and wherein the pushbutton or actuator operates to: (i) move or unlock the pawl or locking mechanism such that the pawl or locking mechanism disengages from the connector; and/or (ii) move or lock the pawl or locking mechanism such that the pawl or locking mechanism engages with the connector. The receiver or receptacle and/or the pawl or locking mechanism may operate to allow a user of the device or system to insert and lock, and/or unlock and remove, the connector using only a single hand of the user. In one or more embodiments, one or more of the following may occur or exist: (i) the connector includes at least one boss protruding beyond the outer surface of the connector; (ii) the receiver or receptacle includes a channel that operates to slidingly accept the boss, the channel having a substantially axial lead-in portion and a substantially circumferential cam portion; (iii) in a case where the boss reaches the end of the channel, and/or the end of the substantially circumferential cam portion of the channel, the window or opening of the connector is aligned with the pawl or locking mechanism such that the pawl or locking mechanism engages with, and locks in place, the connector; and (iv) the connector is turned by a predetermined angle as the boss proceeds from the substantially axial lead-in portion and into and along the substantially circumferential cam portion. The connector may operate to move the pawl or locking mechanism out of the inner volume of the receiver or receptacle as the connector slides into or out of the inner volume in a case where the pawl or locking mechanism is misaligned with the opening or window of the connector, and the pawl or locking mechanism may engage with, and may lock in place, the connector in a case where the pawl or locking mechanism is aligned with the opening or window of the connector.

In one or more embodiments, one or more of the following may occur or exist: (i) the pawl or locking mechanism is pivotably mounted to the receiver or receptacle; (ii) the pawl or locking mechanism is biased with a spring such that the spring biases the pawl or locking mechanism in one direction towards the inner volume or another direction away from the inner volume, and the pushbutton operates to counteract or override the bias of the spring; (iii) the pawl or locking mechanism is mounted in a side portion of the receiver or receptacle via a pin on one end of the pawl or locking mechanism, and the other end of the pawl or locking mechanism operates to interact with the pushbutton; and/or (iv) the spring is located on or in a portion of the pawl or locking mechanism.

In one or more embodiments, one or more of the following may occur or exist: (i) the pushbutton or actuator operates to move linearly towards and away from the pawl or locking mechanism; (ii) the pushbutton or actuator is a linear actuator; and/or (iii) the pushbutton or actuator further comprises an intermediate sliding member not rigidly connected to the linear actuator.

One or more embodiments may further include a linear stage, a motor, and an actuator pin disposed on a shaft of the motor, wherein the linear stage operates to translate the motor and actuator pin and the motor operates to rotate the actuator pin on the shaft of the motor such that the actuator pin is positioned and presses against a first end of the pushbutton or actuator and a second end of the pushbutton or actuator engages with or interacts with the pawl or locking mechanism. The linear stage and the motor may operate to move or position the actuator pin automatically or manually to unlock or disengage the pawl or locking mechanism so that the pawl or locking mechanism is removed from the inner volume of the receptacle or receiver. In a case where a connector is positioned inside the receiver or receptacle and the pawl or locking mechanism is engaged with and locked the connector in place, the linear stage and the motor may operate to move or position the actuator pin automatically or manually to unlock or disengage the pawl or locking mechanism from the connector so that a user of the device or system can remove the connector from the receiver or receptacle using only one hand of the user. The linear stage may be flat or substantially flat, and may be positioned on a flat or substantially flat surface so that the device or system is stationary, immobilized, or operates without an axial force to disengage the pawl or locking mechanism or to remove the pawl or locking mechanism from the inner volume of the receiver or receptacle. In a case where a connector is positioned inside the receiver or receptacle and the pawl or locking mechanism is engaged with and locked the connector in place, the device or system may unlock the pawl or locking mechanism from the connector so that a user of the device or system can remove the connector from the receiver or receptacle with only a single hand of the user.

In one or more embodiments, a bayonet-style connector may not require application of an axial force to disengage, and may include: a connector portion having a substantially cylindrical outside surface, having an axis defined by the substantially cylindrical outside surface, having a boss rigidly attached to the connector portion and protruding outwards from the substantially cylindrical outside surface, and having a window or opening; a receptacle portion having a substantially cylindrical inside surface that operates to slidingly accept the connector portion, the receptacle portion having a channel that operates to slidingly accept the boss, the channel having a substantially axial lead-in portion and a substantially circumferential cam portion, and the receptacle portion having a pawl moveably mounted on the receptacle portion and biased to at least partially protrude springingly and returnably inward and internal to the inside surface; and an actuator that operates to impart force on the pawl, wherein the window or opening of the connector portion operates to receive at least a portion of the pawl, and the actuator operates to retract the pawl from the window or opening such that a user of the bayonet-style connector can remove the connector portion using only one hand of the user. The pawl may be pivotably mounted, and/or may be biased with a spring. The actuator may comprise a linear actuator, and/or may further comprise an intermediate sliding member not rigidly connected to the linear actuator.

In one or more embodiments, a method for controlling a device or system comprising a receiver or receptacle having an inner volume that operates to receive a connector having a window, and having a pawl or locking mechanism that operates to move towards and at least be partially positioned in a portion of the inner volume of the receiver or receptacle; and comprising a pushbutton or actuator that operates to move or unlock the pawl or locking mechanism such that the pawl or locking mechanism operates to move away from and/or out of the inner volume of the receiver or receptacle, and/or operates to move or lock the pawl or locking mechanism such that the pawl or locking mechanism operates to move towards and/or into the inner volume of the receiver or receptacle, may include: positioning the connector in the receiver or receptacle so that the pawl or locking mechanism engages with and is at least partially positioned in the window of the connector; and actuating the pushbutton or actuator to move or unlock the pawl or locking mechanism such that the pawl or locking mechanism is removed and disengages from the window of the connector so that a user of the device or system can remove the connector from the receptacle or receiver by using only one hand of the user. The actuating step may be performed automatically or manually. The method may further include controlling a linear stage, a motor, and an actuator pin disposed on a shaft of the motor of the device or system, wherein the linear stage operates to translate the motor and actuator pin and the motor operates to rotate the actuator pin on the shaft of the motor such that the actuator pin is positioned and presses against a first end of the pushbutton or actuator and a second end of the pushbutton or actuator engages with or interacts with the pawl or locking mechanism. The linear stage and the motor operate to move or position the actuator pin automatically or manually to unlock or disengage the pawl or locking mechanism so that the pawl or locking mechanism is removed from the inner volume of the receptacle or receiver. The method may further include positioning the linear stage and/or the device or system on a flat or substantially flat surface so that the device or system is stationary, immobilized, or operates without an axial force to disengage the pawl or locking mechanism or to remove the pawl or locking mechanism from the inner volume of the receiver or receptacle. One or more methods for controlling a device or system having a controller and/or for controlling a bayonet-style controller may include any other feature(s), including combinations thereof, discussed herein.

In one or more embodiments, a connector or bayonet-style connector may not use application of an axial force to disengage from a device or system and/or a receiver or receptacle of the device or system.

By way of at least one example, at least one embodiment of a connecting apparatus may comprise a cylindrical housing having at least one boss configured on the outer surface of the cylindrical housing, as well as having at least one locking boss configured on the outer surface of the cylindrical housing, other feature as shown or discussed in U.S. Pat. Pub. No. 2017/0294741, filed on Apr. 12, 2017 and published on Oct. 12, 2017, which is incorporated by reference herein in its entirety, and/or as shown or discussed in U.S. Pat. No. 9,869,828, issued on Jan. 16, 2018, the disclosure of which is incorporated by reference herein in its entirety.

In one embodiment of the present disclosure, the locking boss is mounted on a resilient member, configured to resiliently allow the locking boss to depress beneath the outer cylindrical surface of the cylindrical housing.

In another exemplary embodiment, a receiver is provided to receive the connecting apparatus, wherein the receiver includes a cylindrical cavity configured to receive the cylindrical housing, at least one helical cam channel configured to receive the at least one boss, and a chamfer configured to contact the at least one locking boss. In another exemplary embodiment, the receiver also includes a shelf, protruding from the cylindrical cavity, configured to guide the connecting apparatus into the receiver.

In yet another embodiment, the at least one boss protrudes beyond the outer cylindrical surface of the cylindrical housing. According to another embodiment, the at least one locking boss may be used, and may protrude beyond the outer cylindrical surface of the cylindrical housing.

According to yet another exemplary embodiment of the present disclosure, a handle may be used to control or affect the locking boss, and may be in indirect communication with the locking boss through a resilient hinge.

These and other objects, features, and advantages of the present disclosure will become apparent upon reading the following detailed description of exemplary embodiments of the present disclosure, when taken in conjunction with the appended drawings, and provided paragraphs.

BRIEF DESCRIPTION OF THE DRAWINGS

For the purposes of illustrating various aspects of the disclosure, wherein like numerals indicate like elements, there are shown in the drawings simplified forms that may be employed, it being understood, however, that the disclosure is not limited by or to the precise arrangements and instrumentalities shown. It is intended that changes and modifications can be made to the described embodiments without departing from the true scope and spirit of the subject disclosure as defined by the appended paragraphs. To assist those of ordinary skill in the relevant art in making and using the subject matter hereof, reference is made to the appended drawings and figures, wherein.

DETAILED DESCRIPTION OF THE DISCLOSURE

Embodiments will be described below with reference to the attached drawings. Like numbers refer to like elements throughout. It shall be noted that the following description is merely illustrative and exemplary in nature, and is in no way intended to limit the disclosure and its applications or uses. The relative arrangement of components and steps, numerical expressions and numerical values set forth in the embodiments do not limit the scope of the disclosure unless it is otherwise specifically stated. Techniques, methods, and devices which are well known by individuals skilled in the art may not have been discussed in detail since an individual skilled in the art would not need to know these details to enable the embodiments discussed below.

One or more devices or systems, and/or methods for use with same, are provided herein. In one or more embodiments, one or more technique(s) and/or structure(s) may be used to achieve a connector (e.g., a bayonet style connector) which can be operated with a single hand. In one or more embodiments, a device or system using a connector with one or more features of the present disclosure may be stationary, immobilized, on a surface (e.g., a flat surface), on a surface (e.g., a flat surface) but moveable, weighted down on a surface (e.g., a flat surface), etc.

Figure 1:
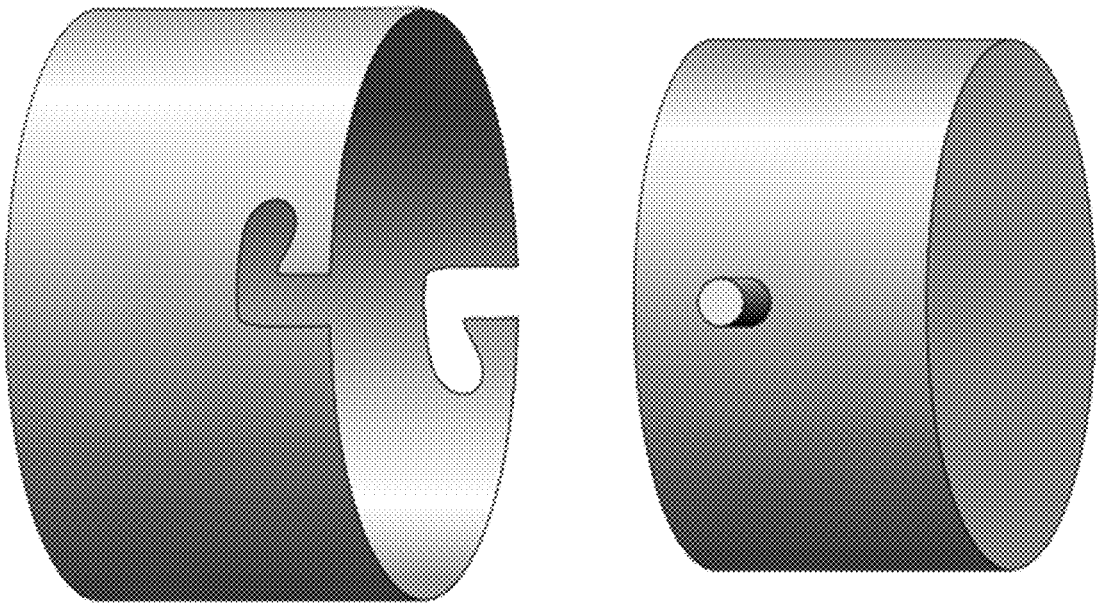
FIG. 1 (PRIOR ART)
FIG. 1 provides a side perspective view of an exemplary bayonet type connector in the prior art.
Figure 2:
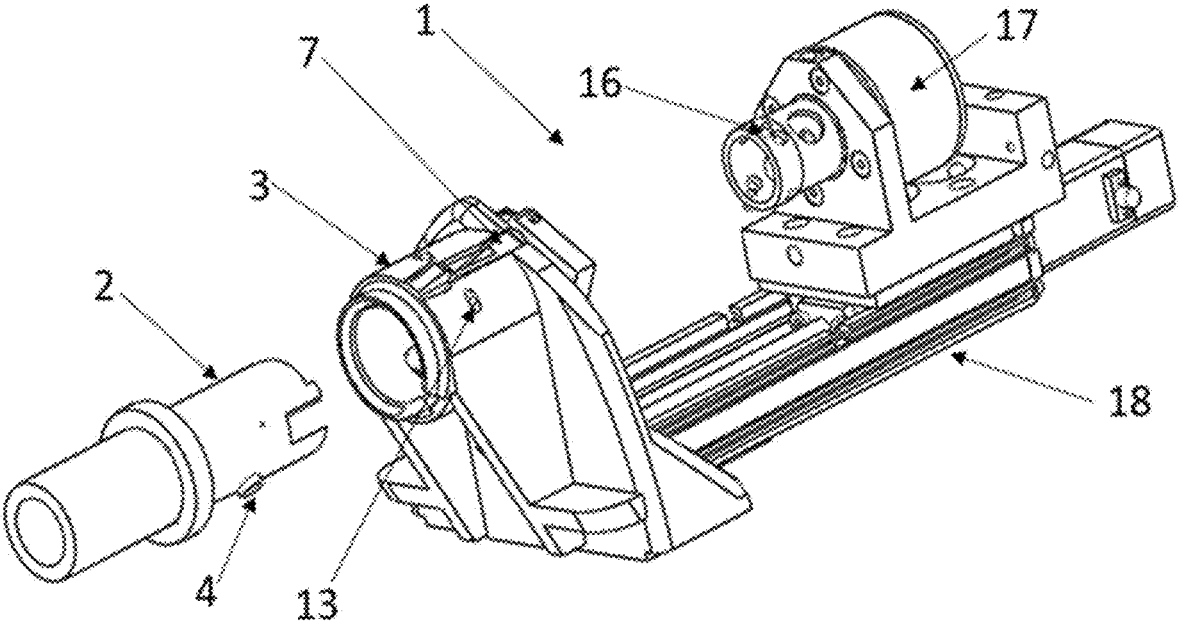
FIG. 2 provides a perspective view of at least one embodiment of a connector and receiver in a device or system in accordance with one or more aspects of the present disclosure.

Turning now to the details of the figures, FIG. 2 depicts at least one embodiment of a device or system 1 having a receiver (also referred to herein as a "receptacle" or a "cylindrical receptacle") 3 that operates to receive a connector (e.g., such as the connector 2 as shown in FIG. 2). As shown in FIG. 2, the connector 2 is shown in a withdrawn or disconnected state such that the connector 2 is outside of (and/or not connected with) the receiver 3. In one or more embodiments, the device or system 1 may have the cylindrical receptacle 3 rigidly attached to the device or system 1.

The receptacle or receiver 3 has an inside or inner diameter such that the receptacle or receiver 3 is sized and shaped to accept the connector 2 therein. Preferably, the inside or inner diameter of the receptacle or receiver 3 is sized and/or shaped to closely accept the connector 2. In one or more embodiments, the receptacle or receiver 3 includes a pawl or locking mechanism (e.g., the pawl or locking mechanism 7 as discussed below) that operates to engage with and/or disengage from a portion (e.g., a window or an opening, such as the window or the opening 12 discussed below) of the connector 2 such that the connector 2 may be inserted into and/or removed from the receptacle or receiver 3 with only one hand. In one or more embodiments, the pawl or locking mechanism 7 may be unlocked or disengaged automatically or manually by the device or system 1 to allow a user of the device or system 1 to remove the connector 2 with one hand of the user.

Figure 3:
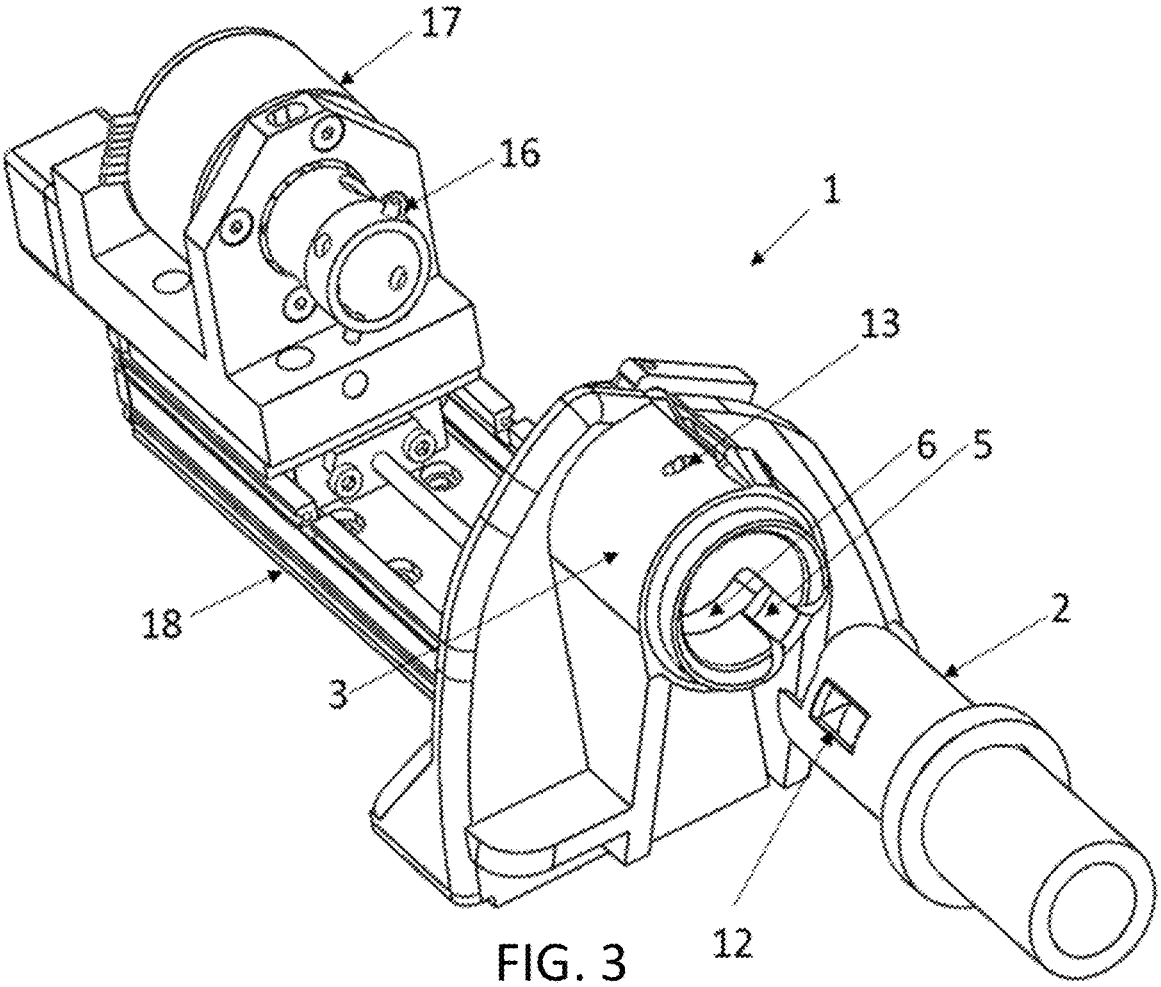
FIG. 3 provides a perspective view of at least one embodiment of a connector and receiver in a device or system in accordance with one or more aspects of the present disclosure.

In one or more embodiments, the receptacle or receiver 3 may have a channel, which may have an axially aligned lead-in portion 5 and a generally circumferential or helical cam portion 6 (as best seen in FIG. 3). In contrast with a standard bayonet connector, in one or more embodiments, there may be no locking portion at the end of the cam portion 6 of the channel. In one or more embodiments, the channel may be sized or shaped differently (e.g., without a cam portion, to accept a portion of the connector 2 having a different structural shape or size than the boss discussed below, etc.). In one or more embodiments, the receptacle or receiver 3 may not include an additional channel such that pawl 7 or other locking mechanism of the receptacle or receiver 3 may engage with and/or disengage from the connector 2 to perform the locking and unlocking feature(s) of the receptacle or receiver 3 and connector 2 arrangement.

In one or more embodiments, the connector 2 may include a boss (e.g., a cylindrical boss) 4 (see FIG. 2, for example) that is sized and/or shaped to slidably fit into the channel (e.g., the lead-in portion 5, the helical cam portion 6, the lead-in portion 5 and the helical cam portion 6, etc.) of the receptacle or receiver 3. The boss 4 may operate to help guide the connector 2 into and/or out of the receptacle or receiver 3.

In one or more embodiments, the connector 2 may be rotated or turned after insertion into the receptacle or receiver 3. For example, after insertion of the connector 2 into the receptacle or receiver 3, the connector 2 may be turned a preset angle α until the boss 4 reaches the end of the channel 6 and stops. By way of another example, after insertion of the connector 2 into the receptacle or receiver 3, the connector 2 may be turned a preset angle α until a predetermined portion (e.g., the opening or window 12 as shown in FIG. 3) of the connector 2 aligns with the locking pawl 7 or other locking mechanism of the receptacle or receiver 3 (best seen in FIGS. 5-8).

As best shown in FIGS. 5-8, the receptacle or receiver 3 may include the pawl or locking mechanism 7 and a pushbutton 14 that operates to actuate the pawl or locking mechanism 7 as discussed below. The pawl or locking pawl 7, may be sized and/or shaped to fit into and/or removed from the predetermined portion (e.g., the opening or window 12) of the connector 2. The pawl or locking mechanism 7 may be pivotally mounted on a pin 13 in the receptacle or receiver 3, and may be located to counter position the predetermined portion (e.g., the opening or window 12) of the connector 2 (e.g., when the connector 2 is inserted into and/or turned at the predetermined angle α (e.g., from an insertion position, within the channel or cam portion 6, etc.). In at least one embodiment, the locking pawl 7 may be biased by a torsional spring 9 towards the axis of the cylindrical receptacle or receiver 3 and inwards of the cylindrical inner surface of the receptacle or receiver 3 (as shown, for example, in an initial, resting, or disengaged state in FIG. 5). The pushbutton 14 may be slidably held in a bushing 15 (see e.g., FIG. 4), may be positioned at a rocking end of the pawl or locking mechanism 7, and may operate, when or in a case where actuated (e.g., pressed), to bias the pawl or locking mechanism 7 from or away from the axis of the cylindrical receptacle or receiver 3 and to the outside of the cylindrical inner surface of the receptacle or receiver 3 against the bias spring 9.

In one or more embodiments, the pawl or locking mechanism 7 and pushbutton 14 arrangement may operate in a reverse or different arrangement. For example, in one or more embodiments, the bias spring 9 or other bias element may bias the pawl or locking mechanism 7 away from the axis of the receptacle or receiver 3 (e.g., the bias spring 9 may operate in the opposite direction or in a different direction), and the pushbutton 14 may be arranged such that, when or in a case where actuated (e.g., pressed or pushed), the pushbutton 14 operates to bias the pawl or locking mechanism 7 towards the axis of the cylindrical receptacle or receiver 3 to lock the pawl or locking mechanism 7 into, or have the pawl or locking mechanism 7 engage with, the predetermined portion (e.g., the window or the opening) of the connector 2.

Figure 4:
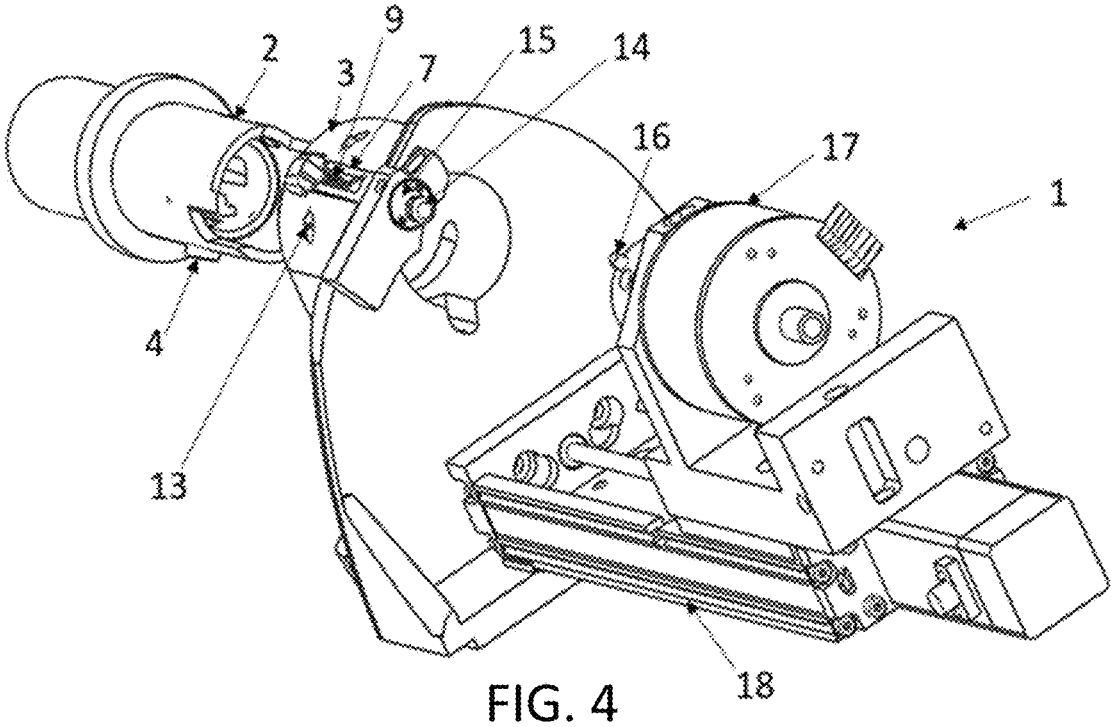
FIG. 4 provides a perspective view of at least one embodiment of a connector and receiver in a device or system from another side of the device or system in accordance with one or more aspects of the present disclosure.

In one or more embodiments, the device or system 1 may include a motor (e.g., a rotary motor) 17 to actuate a push button 14 of the device or system 1 (as shown in FIGS. 3-4). In one or more embodiments (as best seen in FIGS. 2-4), the motor 17 may be mounted on a stage, such as a linear stage 18, of the device or system 1. In one or more embodiments, the motor 17 may include an actuator pin 16 positioned or disposed (or rigidly mounted) on a shaft of the motor 17. In one or more embodiments, the linear stage 18 and motor 17 arrangement operate to: (i) position and press the actuator pin 16 against an internal end (e.g., on an end of the pushbutton 14 facing away from the pawl or locking mechanism 7 (best seen in FIG. 8) of the pushbutton 14; and/or (ii) actuate the pushbutton 14 such that the pawl or locking mechanism 7 is disengaged from the connector 2 and/or moved away from the axis of the receptacle or receiver 3 so that the connector 2 may be removed from the receptacle or receiver 3 (e.g., by using one hand of the user of the device or system 1). The motor 17 may be slid towards or away from the receptacle or receiver 3 via the linear stage 18. The motor 17 and/or the pin 16 may operate to lock and/or unlock the pawl or locking mechanism 7 automatically or manually in a way that provides the user of the device or system 1 with the feature of being able to remove the connector 2 from the receptacle or receiver 3 using only one hand of the user.

Figure 5:
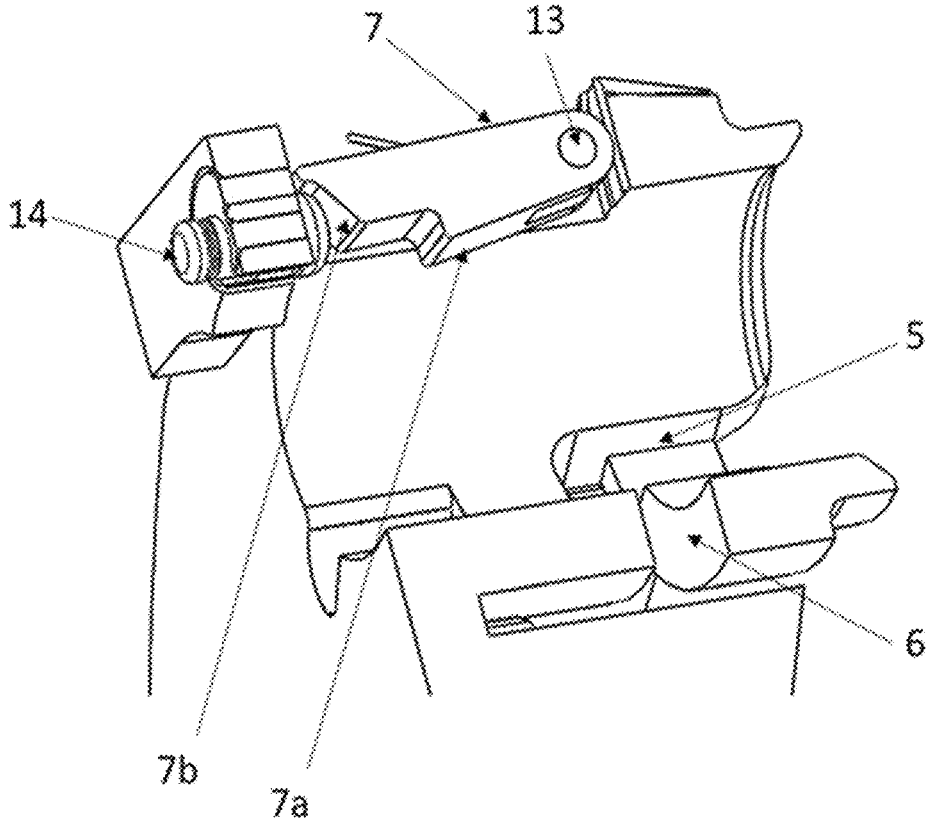
FIG. 5 shows at least one embodiment example of a resting or initial state of a receiver without a connector disposed therein in a device or system in accordance with one or more aspects of the present disclosure.
Figure 6:
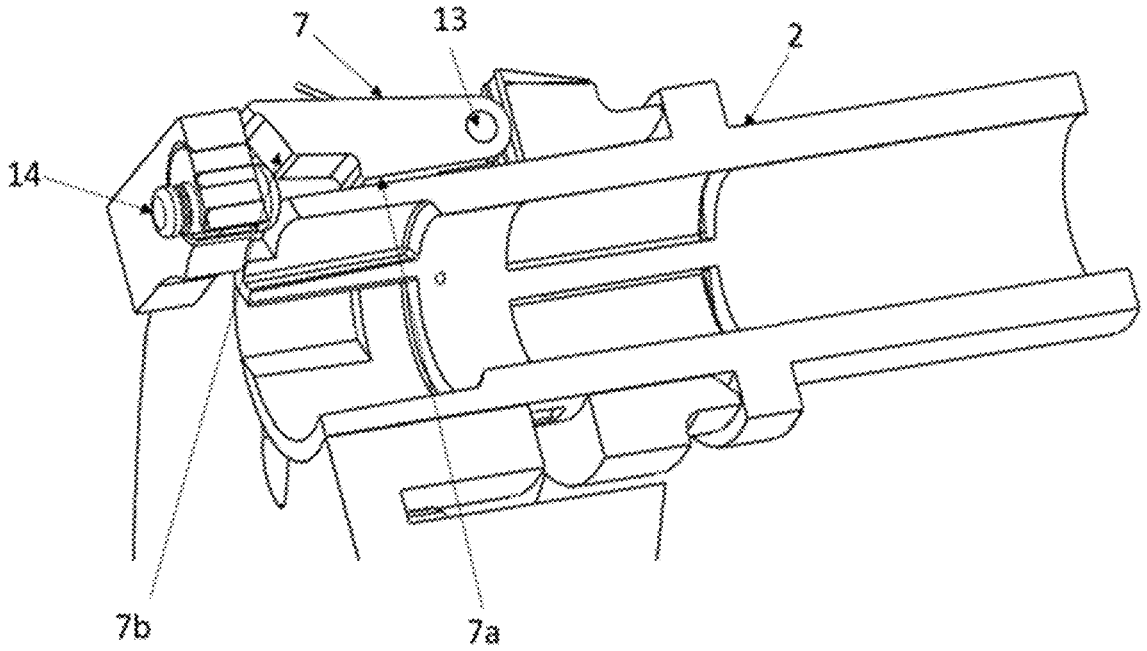
FIG. 6 shows at least one embodiment example of a state of the receiver after a connector is slid into or disposed in the receiver in a device or system in accordance with one or more aspects of the present disclosure.
Figure 7:
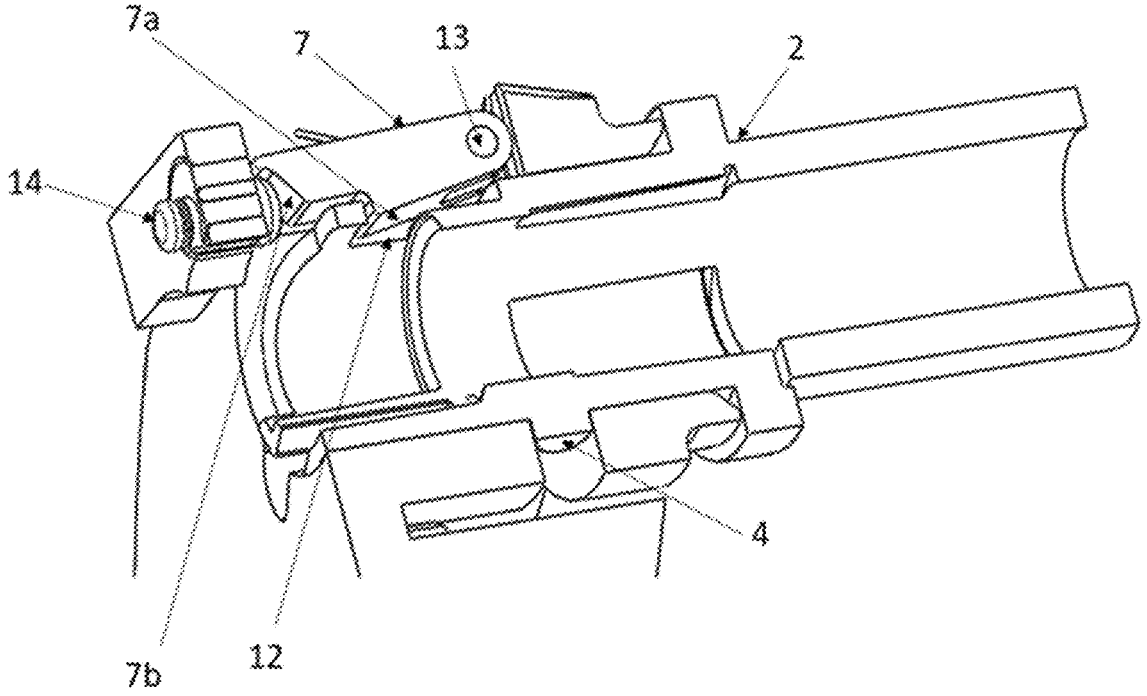
FIG. 7 shows at least one embodiment example of a state of the receiver having a pawl or locking portion engaged in a window or opening of a connector after the connector is slid into or disposed in and rotated within the receiver in a device or system in accordance with one or more aspects of the present disclosure.
Figure 8:
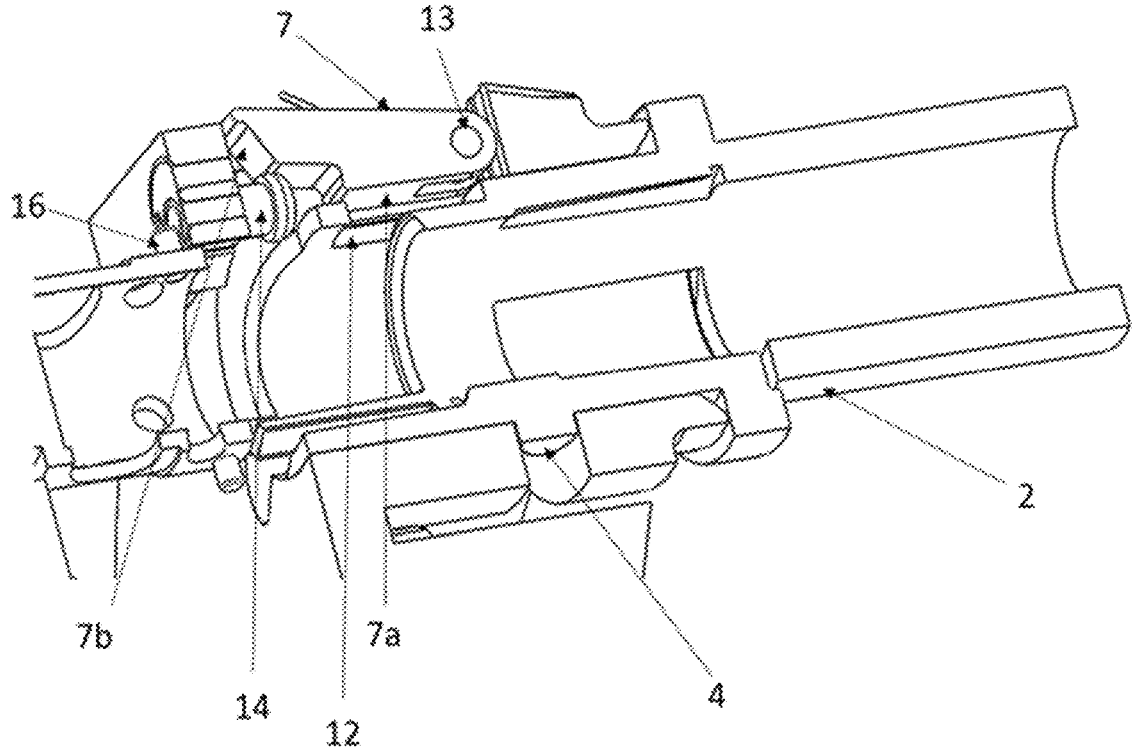
FIG. 8 shows at least one embodiment example of a pushbutton or release mechanism being actuated to disengage the pawl or locking portion from a window or opening of a connector such that the connector may be removed singlehandedly from the device or system in accordance with one or more aspects of the present disclosure.

Now focusing on the details of FIGS. 5-8 of the present disclosure, the device or system 1 may lock or unlock the connector 2 using at least the following embodiment examples and/or using the following locking/unlocking method(s) or technique(s). For instance, as shown in FIG. 5, in an initial or resting state of the receptacle or receiver 3 (e.g., disconnected from or not connected to the connector 2), the pawl or locking mechanism 7 may operate as aforementioned. By way of at least one example, as shown in FIG. 5, the pawl or locking mechanism 7 (or a portion thereof) may be protruding inside of or into the inner diameter of the receptacle or receiver 3 (e.g., when the pawl or locking mechanism 7 is biased inwardly by the spring 9) such that a portion or end portion of the pawl or locking mechanism 7 is biased against an external end (e.g., an end facing towards the pawl or locking mechanism 7) of the pushbutton 14. By way of another example, in one or more embodiments, when (or in a case where) the connector 2 is inserted axially into the receiver or receptacle 3 (see FIG. 6) with the boss 4 fitting into the lead-in portion 5 of the channel, the outer cylindrical surface of the connector 2 may lift the pawl or locking mechanism 7 out of the inner cylindrical volume of the receptacle or receiver 3 against the spring 9. When (or in a case where) the connector 2 reaches the end of the lead-in portion 5, the connector 2 and/or the boss 4 of the connector 2 starts climbing the cam portion 6, and continues until the connector 2 is turned to the angle α and reaches the end of rotational travel. At this point the connector window or opening 12 is positioned opposite (or directly opposite) to, or is aligned with, the pawl or locking mechanism 7, and the spring 9 operates to push a locking portion 7*a* (see e.g., FIGS. 6-8) of the pawl or locking mechanism 7 into the window or opening 12 (see FIG. 7) such that the pawl or locking mechanism 7 operates to lock the connector 2 to the device or system 1 and prevents the connector 2 from disconnecting. In one or more embodiments, the very low frictional force moment created by rotating the connector 2 may be countered by the substantially flat bottom portion of the device or system 1 housing (see e.g., the linear stage 18) placed on any stationary or flat stationary surface.

To disconnect the connector 2 from the device or system 1 (see FIG. 8), in one or more embodiments, the rotary motor 17 may position the actuator pin 16 directly in line with the pushbutton 14, and then the linear stage 18 translates the rotary motor 17 with the actuator pin 16 towards the connector portion (see e.g., the receiver 3 and connector 2 arrangement/combination) of the device 1 until the actuator pin 16 depresses the internal end (e.g., the end facing away from the pawl or locking mechanism 7) of the pushbutton 14. As aforementioned, the device or system 1 may operate such that the motor 17 automatically or manually actuates the pushbutton 14 allowing the user to move the connector 2 using one hand. The depressed or pushed pushbutton 14 translates the linear motion to the outer end (e.g., the end facing the pawl or locking mechanism 7) of the pushbutton 14, and presses on a cam portion 7*b* (see e.g., FIGS. 6-8) of the pawl or locking mechanism 7 forcing the pawl or locking mechanism 7 to pivot out of the window or opening 12 of the connector 2 and release the connector 2 from the device or system 1. At this stage, the connector 2 is no longer locked to the device or system 1 and may be removed now, such as, for example, by using one hand of the user of the device or system 1. Again, one or more features of the present disclosure allow the user of the device or system 1 to plug/connect or unplug/disconnect a connector (e.g., a bayonet style connector, another type of connector, etc.) using just one hand. As aforementioned, the connector 2 may be unlocked or locked automatically from inside of or within the device or system 1, and/or accidental unlocking or locking of the connector 2 by the user may be avoided or prevented.

It should be appreciated that, in one or more embodiments, at no point of a connection and/or disconnection cycle any axial or lateral force is applied to the device or system 1 to displace or move the device or system 1. Preferably, the device or system 1 is supported externally by a surface (e.g., a flat stationary surface, a stationary surface, etc.) on which to dispose or place the device or system 1. In one or more embodiments, the only external support of the device or system 1 may be the presence of a flat stationary surface to put the device or system 1 on with a flat bottom.

Preferably, the connector 2 is a bayonet style connector. However, in one or more embodiments, the connector 2 may have a different structure, size, and/or shape.

One or more embodiments of the device or system 1 may use any other connector features discussed herein, shown in the accompanying features, as discussed or shown in U.S. Pat. Pub. No. 2017/0294741, filed on Apr. 12, 2017 and published on Oct. 12, 2017, the disclosure of which is incorporated by reference herein in its entirety, and/or as shown or discussed in U.S. Pat. No. 9,869,828, issued on Jan. 16, 2018, the disclosure of which is incorporated by reference herein in its entirety.

In one or more embodiments, a locking boss may be used on the connector 2 such that the locking mechanism 7 (or another locking mechanism) engages with the locking boss to lock/unlock the connector 2 from the receiver or receptacle 3. A locking boss may be used with a hinge on the connector 2 such that the locking mechanism 7 (or another locking mechanism) engages with the locking boss to lock/unlock the connector 2 from the receiver or receptacle 3 (and the locking boss may move resiliently between an engaged and a retracted position). A release handle or a button may be added to the device or system 1 to actuate the motor 17 to lock or unlock the pawl or locking mechanism 7 (such that the connector 2 may be locked or unlocked, inserted or removed, etc. from the device or system 1 by using one hand of the user once the motor 17 is finished actuating the pawl or locking mechanism 7). The receptacle or receiver 3 may include one or more features of a receiver (e.g., a bayonet-type receiver) such as an internal cavity for accepting the connector 2, and the internal cavity may include an inner or inside diameter that is configured to be slightly larger than the outside diameter of the connector 2.

Although the disclosure herein has been described with reference to particular embodiments, it is to be understood that these embodiments are merely illustrative of the principles and applications of the present disclosure (and are not limited thereto), and the invention is not limited to the disclosed embodiments. It is therefore to be understood that numerous modifications may be made to the illustrative embodiments and that other arrangements may be devised without departing from the spirit and scope of the present disclosure. The scope of the following claims is to be accorded the broadest interpretation so as to encompass all such modifications and equivalent structures and functions.

The invention claimed is:

1. A connecting and/or disconnecting device comprising:

a receiver or receptacle having an inner volume that operates to receive a connector of the connecting and/or disconnecting device or of another component that operates to connect to and/or disconnect from the connecting and/or disconnecting device, and having a pawl or locking mechanism that operates to move towards and at least be partially positioned in a portion of the inner volume of the receiver or receptacle, wherein: (i) the connector operates to be positioned in the inner volume of the receiver or receptacle, the connector includes a window or opening in a portion or side of the connector, and the connector includes at least one boss protruding beyond an outer surface of the connector, (ii) the pawl or locking mechanism further operates to engage with, and/or disengage from, the window or opening of the connector, (iii) the receiver or receptacle includes a channel that operates to slidingly accept or release and guide the at least one boss of the connector, and (iv), in a case where the boss reaches a first end of the channel of the receiver or receptacle, the window or opening of the connector is aligned with the pawl or locking mechanism such that the pawl or locking mechanism engages with, and locks in place, the connector and/or, in a case where the pawl or locking mechanism disengages from the connector, the boss operates to be guided to a second end of the channel of the receiver or receptacle such that the connector disengages from the receiver or receptacle;

a pushbutton or actuator that: (i) operates to move or unlock the pawl or locking mechanism such that the pawl or locking mechanism operates to move away from and/or out of the inner volume of the receiver or receptacle and such that the pawl or locking mechanism disengages from the window or opening of the connector, and/or (ii) operates to move or lock the pawl or locking mechanism such that the pawl or locking mechanism operates to move towards and/or into the inner volume of the receiver or receptacle such that the pawl or locking mechanism engages with the window or opening of the connector, and a linear stage having an actuator pin disposed on the linear stage, wherein, in a case where the connector is to be disconnected from the receiver or receptacle, the linear stage operates to translate the actuator pin to push against a first end of the pushbutton or actuator such that the pawl or locking mechanism disengages from the window or opening of the connector.

2. The device of claim 1, wherein the receiver or receptacle and/or the pawl or locking mechanism operate(s) to allow a user of the device to insert and lock, and/or unlock and remove, the connector using only a single hand of the user.

3. The device of claim 1, wherein:

(i) the channel of the receiver or receptacle includes a substantially axial lead-in portion and a substantially circumferential cam portion;

(ii) in a case where the boss reaches the end of the substantially circumferential cam portion of the channel, the window or opening of the connector is aligned with the pawl or locking mechanism such that the pawl or locking mechanism engages with, and locks in place, the connector; and (iii) the connector is turned by a predetermined angle as the boss proceeds from the substantially axial lead-in portion and into and along the substantially circumferential cam portion.

4. The device of claim 1, wherein the connector operates to move the pawl or locking mechanism out of the inner volume of the receiver or receptacle as the connector slides into or out of the inner volume in a case where the pawl or locking mechanism is misaligned with the opening or window of the connector, and wherein the pawl or locking mechanism engages with, and locks in place, the connector in a case where the pawl or locking mechanism is aligned with the opening or window of the connector.

5. The device of claim 1, wherein one or more of the following:

(i) the pawl or locking mechanism is pivotably mounted to the receiver or receptacle;

(ii) the pawl or locking mechanism is biased with a spring such that the spring biases the pawl or locking mechanism in one direction towards the inner volume or another direction away from the inner volume, and the pushbutton or actuator operates to counteract or override the bias of the spring;

(iii) the pawl or locking mechanism is mounted in a side portion of the receiver or receptacle via a pin on one end of the pawl or locking mechanism, and the other end of the pawl or locking mechanism operates to interact with the pushbutton or actuator; and/or (iv) the spring is located on or in a portion of the pawl or locking mechanism.

6. The device of claim 1, wherein one or more of the following:

(i) the pushbutton or actuator operates to move linearly towards and/or away from the pawl or locking mechanism;

(ii) the pushbutton or actuator is a linear actuator such that the linear actuator operates to at least move linearly and/or to impart a linear force on the pawl or locking mechanism; and/or (iii) the pushbutton or actuator operates as an intermediate sliding member located in between the pawl or locking mechanism and the actuator pin of the linear stage, and the pushbutton or actuator is separate from the pawl or locking mechanism and the actuator pin of the linear stage.

7. The device of claim 1, further comprising a motor connected to the linear stage, wherein the actuator pin is disposed on a shaft or portion of the motor, wherein the linear stage operates to translate the motor and the actuator pin, and the motor operates to rotate the actuator pin on the shaft or portion of the motor such that the actuator pin is positioned and presses against the first end of the pushbutton or actuator and a second end of the pushbutton or actuator engages with or interacts with the pawl or locking mechanism.

8. The device of claim 7, wherein the linear stage and the motor operate to move or position the actuator pin automatically or manually to unlock or disengage the pawl or locking mechanism so that the pawl or locking mechanism is removed from the inner volume of the receptacle or receiver.

9. The device of claim 8, wherein, in a case where the connector is positioned inside the receiver or receptacle and the pawl or locking mechanism is engaged with and has locked the connector in place, the linear stage and the motor operate to move or position the actuator pin automatically or manually to unlock or disengage the pawl or locking mechanism from the connector so that a user of the device can remove the connector from the receiver or receptacle using only one hand of the user.

10. The device of claim 1, wherein the linear stage is flat, substantially flat, or stationary, and is positioned on a flat, substantially flat, or stationary surface so that the device is stationary, immobilized, or operates without an axial force to disengage the pawl or locking mechanism or to remove the pawl or locking mechanism from the inner volume of the receiver or receptacle.

11. The device of claim 10, wherein, in a case where the connector is positioned inside the receiver or receptacle and the pawl or locking mechanism is engaged with and has locked the connector in place, the device er unlocks the pawl or locking mechanism from the connector so that a user of the device can remove the connector from the receiver or receptacle with only a single hand of the user.

12. A bayonet-style connector not requiring application of an axial force to disengage comprising:

a connector portion having a substantially cylindrical outside surface, having an axis defined by the substantially cylindrical outside surface, having a boss rigidly attached to the connector portion and protruding outwards from the substantially cylindrical outside surface, and having a window or opening;

a receptacle portion having a substantially cylindrical inside surface that operates to slidingly accept the connector portion, the receptacle portion having a channel that operates to slidingly accept the boss, the channel having a substantially axial lead-in portion and a substantially circumferential cam portion, and the receptacle portion having a pawl moveably mounted on the receptacle portion and biased to at least partially protrude springingly and returnably inward and internal to the inside surface; and an actuator that operates to impart force on the pawl, wherein the window or opening of the connector portion operates to receive at least a portion of the pawl, and the actuator operates to retract the pawl from the window or opening such that a user of the bayonet-style connector can remove the connector portion using only one hand of the user.

13. The bayonet-style connector of claim 12, wherein the pawl is pivotably mounted.

14. The bayonet-style connector of claim 12, wherein the pawl is biased with a spring.

15. The bayonet-style connector of claim 12, wherein the actuator comprises a linear actuator such that the linear actuator operates to at least move linearly and/or to impart a linear force on the pawl.

16. The bayonet-style connector of claim 15, wherein the actuator further comprises an intermediate sliding member moveably connected, or not rigidly connected, to the linear actuator.

17. A method for controlling a device comprising a receiver or receptacle having an inner volume that operates to receive a connector of the device or of another component that operates to connect to and/or disconnect from the device, and the receiver or receptacle having a pawl or locking mechanism that operates to move towards and at least be partially positioned in a portion of the inner volume of the receiver or receptacle, wherein: (i) the connector operates to be positioned in the inner volume of the receiver or receptacle, the connector includes a window or opening in a portion or side of the connector, and the connector includes at least one boss protruding beyond an outer surface of the connector, (ii) the pawl or locking mechanism further operates to engage with, and/or disengage from, the window or opening of the connector, (iii) the receiver or receptacle includes a channel that operates to slidingly accept or release and guide the at least one boss of the connector, and (iv), in a case where the boss reaches a first end of the channel of the receiver or receptacle, the window or opening of the connector is aligned with the pawl or locking mechanism such that the pawl or locking mechanism engages with, and locks in place, the connector and/or, in a case where the pawl or locking mechanism disengages from the connector, the boss operates to be guided to a second end of the channel of the receiver or receptacle such that the connector disengages from the receiver or receptacle; the device further comprising a pushbutton or actuator that: (i) operates to move or unlock the pawl or locking mechanism such that the pawl or locking mechanism operates to move away from and/or out of the inner volume of the receiver or receptacle and such that the pawl or locking mechanism disengages from the window or opening of the connector, and/or (ii) operates to move or lock the pawl or locking mechanism such that the pawl or locking mechanism operates to move towards and/or into the inner volume of the receiver or receptacle such that the pawl or locking mechanism engages with the window or opening of the connector; and the device further comprising a linear stage having an actuator pin disposed on the linear stage, the method comprising:

positioning the connector in the receiver or receptacle so that the pawl or locking mechanism engages with and is at least partially positioned in the window of the connector; and in a case where the connector is to be disconnected from the receiver or receptacle, controlling the linear stage to translate the actuator pin to push against a first end of the pushbutton or actuator and actuating the pushbutton or actuator, via the actuator pin, to move or unlock the pawl or locking mechanism such that the pawl or locking mechanism is removed and disengages from the window of the connector so that a user of the device can remove the connector from the receptacle or receiver by using only one hand of the user.

18. The method of claim 17, wherein the controlling step and/or the actuating step is performed automatically or manually.

19. The method of claim 17, wherein the controlling step further comprises controlling a motor connected to the linear stage, wherein the actuator pin is disposed on a shaft or portion of the motor of the device, wherein the linear stage operates to translate the motor and the actuator pin, and the motor operates to rotate the actuator pin on the shaft or portion of the motor such that the actuator pin is positioned and presses against the first end of the pushbutton or actuator and a second end of the pushbutton or actuator engages with or interacts with the pawl or locking mechanism.

20. The method of claim 19, wherein the linear stage and the motor operate to move or position the actuator pin automatically or manually to unlock or disengage the pawl or locking mechanism so that the pawl or locking mechanism is removed from the inner volume of the receptacle or receiver.

21. The method of claim 19, further comprising positioning the linear stage and/or the device on a flat or substantially flat surface so that the device is stationary, immobilized, or operates without an axial force to disengage the pawl or locking mechanism or to remove the pawl or locking mechanism from the inner volume of the receiver or receptacle.

* * * * *